US010764673B2

(12) United States Patent
Kim

(10) Patent No.: US 10,764,673 B2
(45) Date of Patent: Sep. 1, 2020

(54) NOISE CANCELLING EARSET HAVING ACOUSTIC FILTER

(71) Applicant: Orfeo SoundWorks Corporation, Anyang (KR)

(72) Inventor: Eundong Kim, Uiwang (KR)

(73) Assignee: ORFEO SOUNDWORKS CORPORATION, Anyang-si (KR)

( * ) Notice: Subject to any disclaimer, the term of this patent is extended or adjusted under 35 U.S.C. 154(b) by 0 days.

(21) Appl. No.: 16/065,808

(22) PCT Filed: Nov. 30, 2016

(86) PCT No.: PCT/KR2016/013990

§ 371 (c)(1),
(2) Date: Jun. 24, 2018

(87) PCT Pub. No.: WO2017/116023

PCT Pub. Date: Jul. 6, 2017

(65) Prior Publication Data

US 2019/0007768 A1 Jan. 3, 2019

(30) Foreign Application Priority Data

Dec. 30, 2015 (KR) ..... 10-2015-0189237
Jan. 27, 2016 (KR) ..... 10-2016-0009804

(51) Int. Cl.
*H04R 9/06* (2006.01)
*H04R 1/10* (2006.01)
(Continued)

(52) U.S. Cl.
CPC ..... *H04R 1/1083* (2013.01); *G10K 11/04* (2013.01); *G10K 11/16* (2013.01); *H04R 1/1016* (2013.01);
(Continued)

(58) Field of Classification Search
CPC ..... H04R 1/023; H04R 1/086; H04R 1/1016; H04R 1/1083; H04R 1/2823; H04R 1/2888; H04R 9/06; H04R 11/02; H04R 2400/11; H04R 1/1075; H04R 1/2853; H04R 1/2857; H04R 7/12; H04R 2225/025; G10K 11/04
(Continued)

(56) References Cited

U.S. PATENT DOCUMENTS 3,999,020 A * 12/1976 Bastiaans ..... H04R 1/1041 381/372
4,742,887 A * 5/1988 Yamagishi ..... H04R 1/2857 181/129
(Continued)

FOREIGN PATENT DOCUMENTS

JP 2008-312086 A 12/2008
KR 10-2005-0093231 A 9/2005
(Continued)

*Primary Examiner* — Huyen D Le
(74) *Attorney, Agent, or Firm* — Patent Office of Dr. Chung Park

(57) ABSTRACT

Disclosed is a noise cancelling earset having an acoustic filter. The earset includes a dynamic driver unit configured to generate a sound, and an acoustic filter configured to cover a back hole formed in a back of the dynamic driver unit, so that the acoustic filter allows air to pass, but does not allow extraneous noise to pass. The acoustic filter includes filter layers selectively formed with a through-hole and a sound passage, and plates with a through-hole selectively communicating with the through-hole and the sound passage. The filter layers and the plates are alternatively disposed on each other, and the through-holes of the plates communicate with the through-holes or the sound passages of the filter layers.

19 Claims, 4 Drawing Sheets

(51) Int. Cl.

| | |
|---|---|
| ***H04R 1/28*** | (2006.01) |
| ***G10K 11/16*** | (2006.01) |
| ***G10K 11/04*** | (2006.01) |
| ***H04R 9/02*** | (2006.01) |
| ***H04R 11/02*** | (2006.01) |

(52) U.S. Cl.
CPC ..... *H04R 1/1058* (2013.01); *H04R 1/2857* (2013.01); *H04R 9/025* (2013.01); *H04R 9/06* (2013.01); *H04R 11/02* (2013.01); *H04R 1/2888* (2013.01); *H04R 2225/025* (2013.01); *H04R 2400/11* (2013.01)

(58) Field of Classification Search
USPC ..... 381/345, 346, 348, 349, 353, 354, 370, 381/372, 373, 189, 375, 380, 417, 418, 381/432
See application file for complete search history.

(56) References Cited

U.S. PATENT DOCUMENTS 5,222,050 A * 6/1993 Marren ..... H04R 1/44 181/132
5,828,012 A * 10/1998 Repolle ..... G10K 11/18 181/175
6,243,472 B1 * 6/2001 Bilan ..... H04R 1/06 29/594
7,436,973 B2 * 10/2008 Liao ..... H04R 1/1041 381/370
8,023,687 B2 * 9/2011 Matsuda ..... H04R 7/20 381/398
8,515,116 B2 * 8/2013 Lee ..... H04R 1/1041 381/338
2012/0099738 A1 * 4/2012 Lee ..... H04R 1/105 381/74
2013/0058508 A1 * 3/2013 Oosato ..... H04R 1/1075 381/162
2013/0315431 A1 * 11/2013 Grinker ..... H04R 1/1016 381/380

FOREIGN PATENT DOCUMENTS

KR 10-0694160 A 3/2007
KR 10-1185803 B1 10/2012
KR 10-1535916 B1 7/2015

* cited by examiner

NOISE CANCELLING EARSET HAVING ACOUSTIC FILTER

CROSS-REFERENCE TO PRIOR APPLICATIONS

This application is a national Stage Patent Application of PCT International Patent Application No. PCT/KR2016/013990, filed on Nov. 30, 2016 under 35 U.S.C. § 371, which claims priority of Korean Patent Application Nos. 10-2015-0189237, filed on Dec. 30, 2015 and 10-2016-0009804, filed on Jan. 27, 2016, which are all hereby incorporated by reference in their entirety.

TECHNICAL FIELD

The present invention relates to a noise cancellation technology. More particularly, the present invention relates to a noise cancellation earset having an acoustic filter which can equally maintain atmospheric pressure between inner and outer sides of the earset and completely cancel extraneous noise.

BACKGROUND ART

An earset is an audio equipment that is disposed in an earflap or auricle and an external auditory meatus to listen to a sound, for example, an in-ear earphone.

If the earset is disposed in the external auditory meatus, there is a pressure difference between an inner side (human pressure) and an outer side (atmospheric pressure) of the earset. In other words, when an ear cap or tip of the earset is brought into close contact with an inner wall of the external auditory meatus, a pressure difference occurs between the inner and outer sides of the earset.

A vibrating diaphragm is influenced by the pressure difference, and thus may be offset toward the outer side of the earset.

In order to prevent the vibrating diaphragm from being offset, a dynamic driver unit and a balanced armature driver unit are provided at their backs with a back hole. The back hole is to equally maintain the atmospheric pressure between the inner and outer sides of the earset. This causes the vibrating diaphragm to vibrate at a proper position. In addition, in case of covering the back hole with dampers having different mesh density or the like, a pressure difference occurs between the dampers upon operation of the vibrating diaphragm, which is used for tuning.

There is a problem in that the back hole serves as a passage through which an extraneous noise passes. In order to use the earset at a place where is required to completely cancel the extraneous noise, for example, an airport or the like, the extraneous noise should be completely cancelled. However, it is hard to completely cancel the extraneous noise due to the back hole formed in the back of the driver unit.

Meanwhile, the earset integrated with a speaker and a microphone carries out in one body a function of transmitting a sound to an external auditory meatus and a function of collecting a sound of a user. In general, the speaker is disposed toward the external auditory meatus to transmit the sound, while the microphone is exposed outwardly from the auricle to collect the sound of the user. Even in case of such an earset, there is a problem in that an extraneous noise is input through a sound collecting hole which is formed in the microphone to collect the sound, and then the extraneous noise comes in through the back hole formed in the back of the driver unit. In case of an in-ear microphone with a microphone facing the external auditory meatus, there is a problem in that a sound quality is deteriorated due to the extraneous noise, regardless of an installation position of the in-ear microphone. To prevent the above problem, if the back hole formed in the back of the driver unit is closed, the vibrating diaphragm is offset, so that the in-ear microphone cannot be used in an aircraft or a mountainous area.

Therefore, it is necessary to cancel the extraneous noise outputting from the back holes formed in the backs of the dynamic driver unit and the balanced armature driver unit and allow air to flow.

DISCLOSURE

Technical Problem

Accordingly, an object of the present invention is to provide a noise cancellation earset having an acoustic filter which can equally maintain atmospheric pressure between inner and outer sides of the earset and completely cancel extraneous noise.

Technical Solution

To accomplish the above object, according to one aspect of the present invention, there is provided a noise cancellation earset including a dynamic driver unit configured to generate a sound, and an acoustic filter configured to cover a back hole formed in a back of the dynamic driver unit, so that the acoustic filter allows air to pass, but does not allow extraneous noise to pass.

The acoustic filter includes filter layers selectively formed with a through-hole and a sound passage, and plates with a through-hole selectively communicating with the through-hole and the sound passage. The filter layers and the plates are alternatively disposed on each other, and the through-holes of the plates communicate with the through-holes or the sound passages of the filter layers. The through-holes formed in the plates adjacent to the filter layers communicate with different ends of the sound passages of the corresponding filter layers. In addition, the sound passage of the adjacent filter layer is preferably formed to be elongated so that a high-tone sound does not pass, but a low-tone sound passes.

The sound passage is filled with a sound absorbing material. The sound absorbing material contains at least one of polyester, glass fiber, mineral wool, glass wool, and polyurethane.

Advantageous Effects

With the configuration of the present invention, the high band and the middle band are eliminated by the acoustic filter, and only the low band of up to 100 Hz passes. Since the low band is filtered and does not pass under Bluetooth standard, the air passes through the acoustic filter, but the extraneous noise is completely canceled.

In case where the sound comes back through the back hole by the operation of the driver unit, the low band of up to 100 Hz is output from the acoustic filter, thereby minimizing the effect of the sound generated in the earset. That is, even though the sound of a low band is input to the microphone (e.g., in-ear microphone), a filtering process of eliminating the high band and the low band is carried out to reduce data quantity on Bluetooth transmission, thereby minimizing the effect of the noise generated in the earset.

MODE FOR INVENTION

Figure 1:
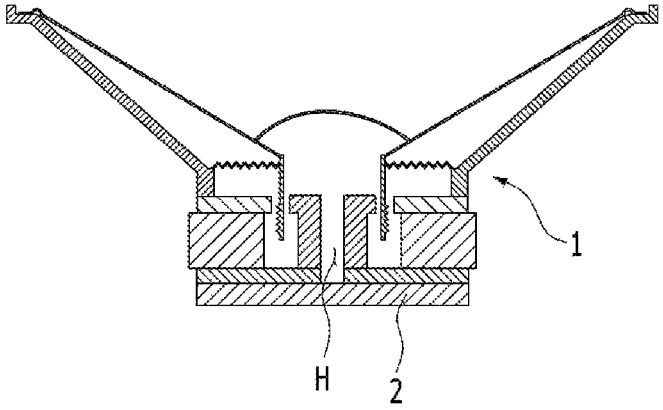
FIG. 1 is a cross-sectional view illustrating a noise cancellation earset having an acoustic filter according to one embodiment of the present invention.

The present invention will now be described in detail with reference to the accompanying drawings, in which the same reference numerals refer to the same components.

Unless the context indicates otherwise, it will be further understood that the terms "comprising" and/or "having" when used in this specification, specify the presence of stated features, integers, steps, operations, elements, and/or components, but do not preclude the presence or addition of one or more other features, integers, steps, operations, elements, components, parts or combination thereof.

It also should be understood that components designated as a means, a part, a module, or a block in the detailed description and the claims mean a unit for carrying out at least one function or operation, and the respective components may be implemented by software, hardware or a combination thereof.

Hereinafter, a noise cancellation earset having an acoustic filter according to embodiments of the present invention will be described in detail with reference to the accompanying drawings.

FIG. 1 is a cross-sectional view illustrating a noise cancellation earset having an acoustic filter according to one embodiment of the present invention.

Referring to FIG. 1 showing the noise cancellation earset having a dynamic driver unit according to one embodiment of the present invention, the noise cancellation earset includes a dynamic driver unit 1 and an acoustic filter 2 for covering a back hole formed in a back of the dynamic driver unit 1.

The noise cancellation earset of the present invention equally maintains atmospheric pressure between inner and outer sides of the earset by use of the acoustic filter 2 covering the back hole, and cancels an extraneous noise outputting through the back hole.

In case where a sound comes back through the back hole by operation of the dynamic driver unit 1, the noise cancellation earset outputs a low band of up to 100 Hz from the acoustic filter 2.

Figure 2:
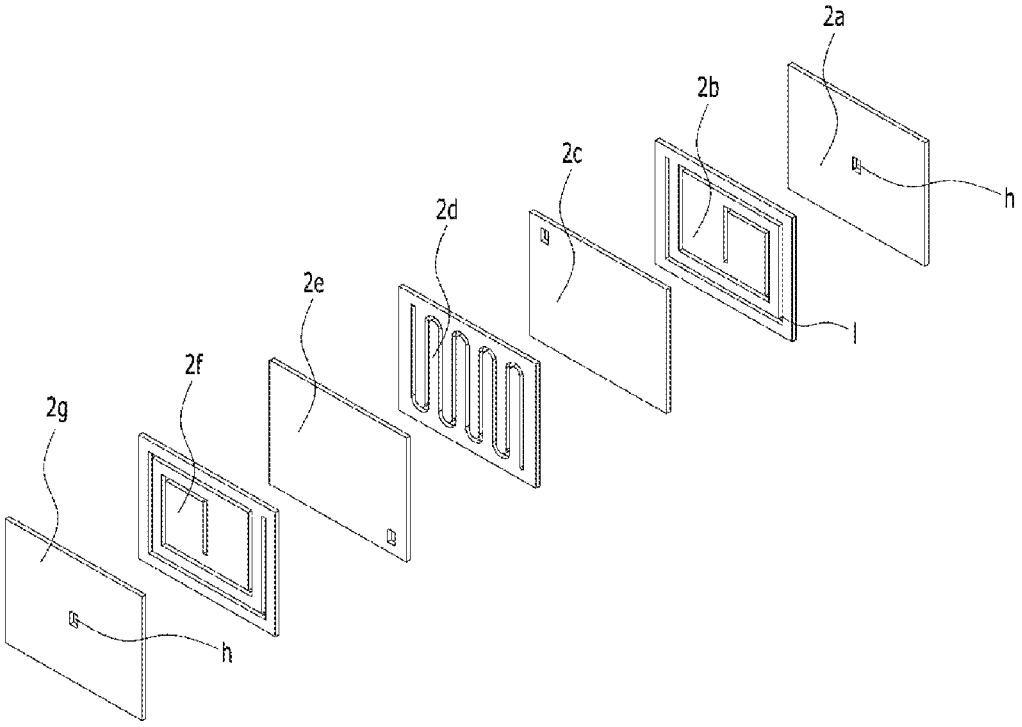
FIG. 2 is an exploded perspective view of the acoustic filter according to the embodiment of the present invention.

FIG. 2 is an exploded perspective view of the acoustic filter according to the embodiment of the present invention.

Referring to FIG. 2, the acoustic filter 2 of the present invention has filter layers 2*b*, 2*d* and 2*f* selectively formed with through-holes and sound passages 1, and plates 2*a*, 2*c* and 2*e* with through-holes h selectively communicating with the through-holes and the sound passages 1.

The acoustic filter 2 has a cover 2*g* at an outermost side thereof.

The filter layers 2*b*, 2*d* and 2*f* and the plates 2*a*, 2*c* and 2*e* may be alternatively disposed on each other, in the state in which the through-holes h of the plates 2*a*, 2*c* and 2*e* communicate with the through-holes or the sound passages 1 of the filter layers 2*b*, 2*d* and 2*f*. Specifically, the through-holes or the sound passages 1 of the filter layers 2*b*, 2*d* and 2*f* communicate with the through-holes h of the adjacent plates 2*a*, 2*c* and 2*e*. Meanwhile, the through-holes h formed in the plates 2*a*, 2*c* and 2*e* adjacent to any one of the filter layers 2*b*, 2*d* and 2*f* preferably communicate with different ends of the sound passages 1 of the corresponding filter layers 2*b*, 2*d* and 2*f*. Of course, the through-holes h formed in the plates 2*a*, 2*c* and 2*e* can communicate with any portion of the sound passages 1 of the filter layers 2*b*, 2*d* and 2*f*, and the number of communicating portions is not limited.

The sound passages 1 formed in the filter layers 2*b*, 2*d* and 2*f* may be formed in various shapes, such as a vortex or a zigzag. Preferably, the sound passages 1 formed in the adjacent filter layers 2*b*, 2*d* and 2*f* may be perpendicular to each other.

A plurality of different sound passages 1 may be formed in the filter layers 2*b*, 2*d* and 2*f*, and a plurality of through-holes may be formed in the adjacent plates 2*a*, 2*c* and 2*e* corresponding to the plurality of sound passages 1.

Although the earset including three filter layers 2*b*, 2*d* and 2*f*, three plates 2*a*, 2*c* and 2*e* and one cover 2*g* is illustrated and explained in this embodiment, the filter layers 2*b*, 2*d* and 2*f* and the plates 2*a*, 2*c* and 2*e* may be properly combined.

Although this embodiment illustrates the case where the sound passages 1 are formed in the filter layers 2*b*, 2*d* and 2*f*, the sound passages 1 may be formed in the plates 2*a*, 2*c* and 2*e*, and the through-holes may be formed in the filter layers.

The acoustic filter 2 is attached to the back hole of the dynamic driver unit 1 to filter a sound input or output to or from the back hole.

Figure 3:
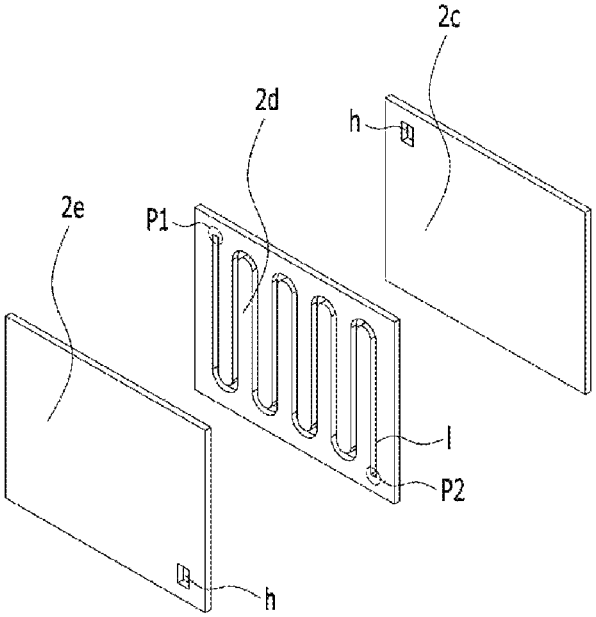
FIG. 3 is an enlarged perspective view of the acoustic filter according to the embodiment of the present invention.

FIG. 3 is an enlarged perspective view of the acoustic filter according to the embodiment of the present invention.

Referring to FIG. 3, the filter layer 2*d* is provided with the sound passage 1, and the plates 2*c* and 2*e* are provided with the through-hole h.

Ends of the sound passage 1 formed in the filter layer 2*d* correspond to positions P1 and P2 of the through-holes h formed in the plates 2*c* and 2*e*, so that the sound passage 1 communicates with the through-hole h.

A size (width) of the sound passage 1 formed in the respective filter layers may be different from each other, and may be determined depending upon a shape of the sound passage 1.

A size of the through-holes h formed in the plates 2*c* and 2*e* may be different from each other.

The filter layer 2*d* is made of polyester, glass fiber, mineral wool, glass wool, polyurethane or the like. The filter layer 2*d* serves as a function of absorbing a sound and preventing vibration or echo.

The plates 2*c* and 2*e* are preferably made of a thin metal plate or a sheet of synthetic resin, and usually serve as a function of sealing the sound passage 1.

The sound passage 1 may be filled with a sound absorbing material, and the sound absorbing material can be selected from the above-described material of the filter layer 2*d*.

With the above configuration of the acoustic filter 2, most of the sound is absorbed while passing through the sound passages 1 extending in various horizontal and vertical directions. Specifically, a high band and a middle band are absorbed, but only a low band of up to 100 Hz passes. In addition, air passes through the back hole, and thus atmospheric pressure is equally maintained between inner and outer side of the earset. After all, only air passes through the acoustic filter 2, but most of the sound is cancelled.

Figure 4:
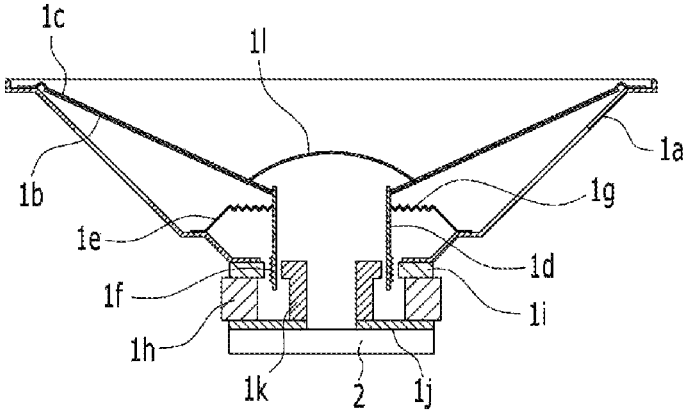
FIG. 4 is a cross-sectional view illustrating a dynamic driver unit according to an application of the present invention.

FIG. 4 is a cross-sectional view illustrating a dynamic driver unit according to an application of the present invention.

Referring to FIG. 4, a dynamic driver unit 1 according to one embodiment of the present invention includes a conical hollow frame (yoke) 1*a*, a conical hollow vibrating diaphragm 1*b* which vibrates in the frame 1*a*, an edge surround 1*c* elastically supporting a front end of the vibrating diaphragm 1*b* at a front end of the frame 1*a*, a bobbin 1*d* with a front end being adhered to a center portion of the vibrating diaphragm 1*b* from a rear side of the vibrating diaphragm 1*b*, a damper 1*e* with an outer peripheral portion being fixed to the frame 1*a* and an inner peripheral portion being adhered to the bobbin 1*d*, a voice coil 1*f* wound around the bobbin 1*d*, a spider 1*g* supporting the voice coil 1*f*, a ring-shaped permanent magnet 1*h* disposed around the voice coil 1*f*, a ring-shaped front plate li firmly disposed between the frame 1*a* and the permanent magnet 1*h*, a ring-shaped rear plate 1*j* covering a lower portion of the permanent magnet 1*h*, a ring-shaped pole piece 1*k* protruding in the bobbin 1*d* from the rear plate 1*j*, with a vibration space where the bobbin 1*d* vibrates up and down being provided between the permanent magnet 1*h* and the front plate 1*j*, and a dust cap 11 disposed at a center of the vibrating diaphragm 1*b*.

In the dynamic driver unit 1 including the above configuration, the permanent magnet 1*h*, the front plate 1*i*, the rear plate 1*j* and the pole piece 1*k* form a magnetic circuit, and if the voice coil 1*f* is magnetic by application of an electric current, the voice coil 1*f* is pushed or pulled according to a magnetic pole of the voice coil 1*f*. Specifically, if the voice coil 1*f* and the permanent magnet 1*h* have the same magnetic pole, the voice coil 1*f* is repelled, but if the voice coil 1*f* and the permanent magnet 1*h* have the different magnetic pole, the voice coil 1*f* is attracted, thereby the voice coil 1*f* vibrates. When the voice coil 1*f* vibrates, the vibrating diaphragm 1*b* fixed to the voice coil 1*f* vibrates to generate a sound.

The acoustic filter 2 covers the back hole formed in the back of the dynamic driver unit 1 to cancel the extraneous noise, as well as a sound generated by the operation of the vibrating diaphragm and coming back from the back hole.

Figure 5:
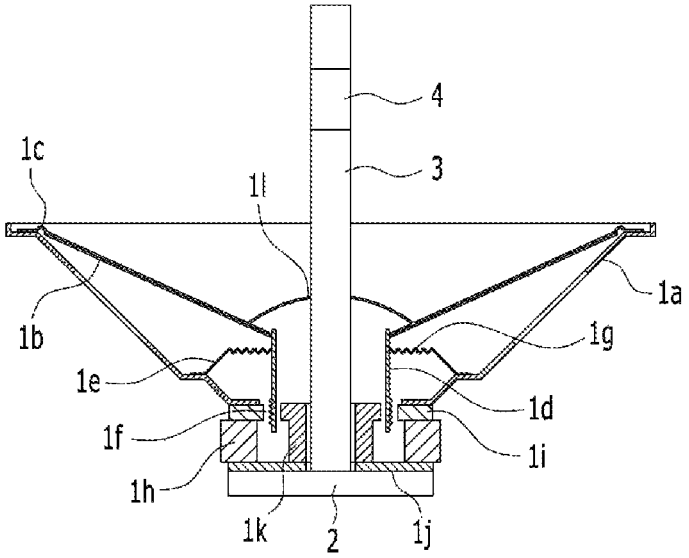
FIG. 5 is a cross-sectional view illustrating an earset having a dynamic driver unit and an in-ear microphone according to another application of the present invention.

FIG. 5 is a cross-sectional view illustrating an earset having a dynamic driver unit and an in-ear microphone according to another application of the present invention.

Referring to FIG. 5, the earset according to this embodiment is substantially identical to the earset including the dynamic driver unit 1 shown in FIG. 4, except that a hole is formed in a center of the dust cap, a tube 3 penetrates the dynamic driver unit 1, and an in-ear microphone 4 is embedded in the tube 3.

The tube 3 is isolated from a sound output space of the speaker, and the speaker is provided at a front thereof with a hollow channel, in which the in-ear microphone 4 is built, to minimize the installation space and thus downsize the whole volume.

One end of the tube 3 is preferably connected to any one of the rear plate, the pole piece, and the front plate, and communicates with the back hole. The other end may be fixed to a nozzle or the like.

One end of the tube 3 is preferably covered by the acoustic filter 2.

In case of a conventional earset with no acoustic filter 2, the sound generated by the operation of the vibrating diaphragm comes back from the back hole, and then comes in the in-ear microphone 4 through the tube 3. Therefore, a howling phenomenon may occur.

However, in case of the earset having the acoustic filter according to the present invention, when the sound generated by the operation of the vibrating diaphragm comes back from the back hole, the sound passes through the acoustic filter 2, so that only a low band of up to 100 Hz is output.

Meanwhile, a wireless earset with a Bluetooth communication module and a DSP carries out a filtering operation of reducing a data volume for the purpose of wireless transmission, thereby eliminating a high band and a low band. That is, since the low band of up to 100 Hz came back from the back hole by the operation of the vibrating diaphragm is completely eliminated in the filtering process for the purpose of the wireless transmission, the noise to be input to the in-ear microphone 4 is substantially eliminated.

Figure 6:
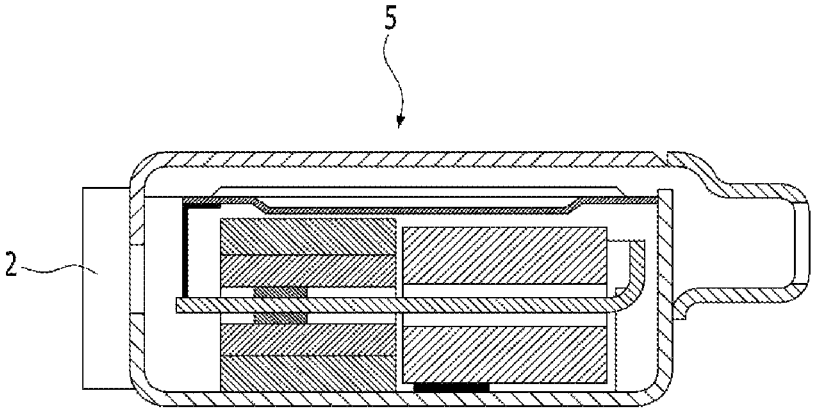
FIG. 6 is a cross-sectional view illustrating a noise cancellation earset having an acoustic filter according to another embodiment of the present invention.

FIG. 6 is a cross-sectional view illustrating a noise cancellation earset having an acoustic filter according to another embodiment of the present invention.

Referring to FIG. 6, the noise cancellation earset having a balanced armature driver unit according to this embodiment includes a balanced armature driver unit 5 and an acoustic filter 2 covering a back hole formed in a back of the balanced armature driver unit 5.

The noise cancellation earset according to the present invention equally maintains the atmospheric pressure between inner and outer sides of the earset by use of the acoustic filter 2 covering the back hole, and cancels the extraneous noise coming from the back hole.

In case where the sound comes back from the back hole by the operation of the balanced armature driver unit 5, only the low band of up to 100 Hz is output through the acoustic filter 2.

Figure 7:
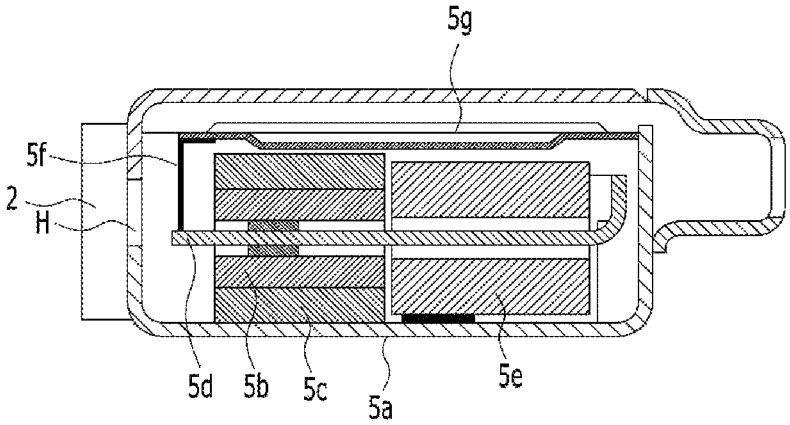
FIG. 7 is a cross-sectional view illustrating a balanced armature driver unit according to one example of the present invention.

FIG. 7 is a cross-sectional view illustrating the balanced armature driver unit according to one example of the present invention.

Referring to FIG. 7, a balanced armature driver unit 5 according to the example of the present invention includes a frame 5*a*, a pair of permanent magnets 5*b* spaced apart from each other and installed in the frame 5*a*, a yoke plate 5*c* covering the permanent magnets 5*b*, an armature 5*d* having one side positioned between the permanent magnets 5*b*, with an air gap being therebetween, and the other side fixed to the frame 5*a*, a coil 5*e* wound around a portion of the armature 5*d* to induce an AC magnetic field between the armature 5*d* and the permanent magnets 5*b*, a connecting rod 5*f* connected to the armature 5*d*, and a vibrating diaphragm 5*g* connected to and vibrated by the connecting rod 5*f* and supported by the frame 5*a*.

The frame 5*a* is formed in a rectangular shape, but the shape of the frame 5*a* is not limited thereto. The frame 5*a* may be made from a soft material, such as aluminum or soft resin.

The pair of permanent magnets 5*b* are spaced apart from each other to induce a DC magnetic field, and has an upper magnet and a lower magnet.

The yoke plate 5*c* is provided to form a closed circuit having the upper magnet and the lower magnet. Specifically, a constant static magnetic field is induced by the upper magnet and the lower magnet, and a return path to the static magnetic field is restrained by the yoke plate 5*c*. The yoke plate 5*c* may be made from a material of a high magnetic property (high magnetic permeability).

One end of the armature 5*d* is positioned between the pair of spaced permanent magnets 5*b*. The other end thereof opposite to one end is bent in an upward direction, and is fixed to the frame 5*a*. The bent structure of the other end may be formed in various shapes. If it is configured to be fixed to the frame 5*a*, any shapes can be selected. Since the entire height is lowered by the bent structure of the other end, the volume can be reduced. The armature 5*d* may be formed by stamping out a metal strip. One end of the metal sheet can be easily bent. The armature 5*d* may contain a conventional magnetic material, such as permalloy (otherwise, Fe-Ni magnetic alloy), a Fe-Si material, such as silicon steel, or other materials. The armature 5*d* may be made from a material of a high magnetic property (high magnetic permeability). The armature 5*d* interposed between the permanent magnets 5*b* may have an air gap between the permanent magnets 5*b* and the armature 5*d*.

The coil 5*e* is wound around a portion of the armature 5*d*, and if a signal current is applied thereto, the armature 5*d* generates a magnetic flux to induce an AC magnetic field between the armature 5*d* and the permanent magnets 5*b*.

The connecting rod 5*f* may be made from a non-magnetic material having rigidity.

With the above configuration of the armature driver unit 5, when the signal current is applied to the coil 5*e*, the DC magnetic field is induced between the armature 5*d* and the permanent magnets 5*b* by the magnetic flux generated in the armature 5*d*, and then the AC magnetic field is overlapped with the DC magnetic field induced between the permanent magnets 5*b*, so that the armature 5*d* is deformed in a vertical direction. Therefore, the connecting rod 5*f* connected to the armature 5*d* is displaced in the vertical direction. The displacement of the connecting rod 5*f* is transferred to the vibrating diaphragm 5*g* fixed to the upper end thereof, and thus the vibrating diaphragm vibrates to generate the sound. The sound is output outwardly from the nozzle, and then is transmitted to a user's ear.

The back hole formed in the back of the balanced armature driver unit 5 is covered by the acoustic filter 2 to cancel the extraneous noise and prevent the sound generated by the operation of the vibrating diaphragm 5*g* from coming back from the back hole.

Meanwhile, the balanced armature driver unit 5 and the in-ear microphone can be embedded in one case, and the tube is isolated from the sound output space of the speaker. The in-ear microphone can be built in the tube. The functions illustrated and explained in FIG. 7 are substantially identical to those in FIG. 5, and thus will not be explained in detail.

The technical thoughts of the present invention have been described hereinbefore with reference to the embodiments.

It is to be appreciated that those skilled in the art can change or modify the embodiments without departing from the scope and spirit of the present invention. While the present invention has been described with reference to the particular illustrative embodiments, it is not to be restricted by the embodiments but only by the appended claims. It is to be appreciated that those skilled in the art can change or modify the embodiments without departing from the scope and spirit of the present invention.

The invention claimed is:

1. A noise cancelling earset comprising:

a driver unit configured to generate a sound;

an acoustic filter configured to cover a back hole formed in the driver unit, wherein acoustic filter is disposed between the back hole and a passageway through which an extraneous noise from outside of an external auditory meatus of a wearer of the earset travels, wherein the acoustic filter allows air to pass therethrough so that the back hole is in a fluid communication with the passageway and an air pressure in the back hole is same as an air pressure in the passageway and wherein the acoustic filter blocks the extraneous noise so that the extraneous noise is prevented from entering the back hole;

a tube having one end disposed in the back hole and extending through the driver unit to define an inner space that is isolated from a sound output space of the driver unit and having an other end into which a sound generated by the wearer and transmitted through the external auditory meatus of the wearer enters; and a microphone disposed in the inner space of the tube and configured to capture the sound that enters into the other end of the tube, the driver unit and the microphone being installed within a housing that is configured to be mounted inside the external auditory meatus of the wearer, wherein the acoustic filter includes:

a plurality of filter layers each of the plurality of filter layers including at least one of a through-hole and a sound passage, and a plurality of plates, each of the plurality of plates including a through-hole that is fluidically communicating with the at least one of the through-hole and the sound passage.

2. The noise cancelling earset according to claim 1, wherein the plurality of filter layers and the plurality of plates are alternatively disposed on each other.

3. The noise cancelling earset according to claim 1, wherein the through-holes formed in two of the plurality of plates adjacent to a filter layer communicate with different ends of the sound passage of the filter layer.

4. The noise cancelling earset according to claim 1, wherein the sound passages formed in two adjacent filter layers of the plurality of filter layers are arranged in perpendicular to each other.

5. The noise cancelling earset according to claim 1, wherein the sound passage is filled with a sound absorbing material.

6. The noise cancelling earset according to claim 5, wherein the sound absorbing material contains at least one of polyester, glass fiber, mineral wool, glass wool, and polyurethane.

7. The noise cancelling earset according to claim 1, wherein the driver unit includes at least one of a dynamic driver unit and a balanced armature driver unit.

8. The noise cancelling earset according to claim 7, wherein the dynamic driver unit includes a conical hollow frame, a hollow conical-hollow shaped vibrating diaphragm vibrating in the frame, an edge surround elastically supporting a front end of the vibrating diaphragm at a front end of the frame, a bobbin with a front end adhered to a center portion of the vibrating diaphragm from a rear side of the vibrating diaphragm, a damper with an outer peripheral portion fixed to the frame and an inner peripheral portion adhered to the bobbin, a voice coil wound around the bobbin, a spider supporting the voice coil, a ring-shaped permanent magnet disposed around the voice coil, a ring-shaped front plate firmly disposed between the frame and the permanent magnet, a ring-shaped rear plate covering a lower portion of the permanent magnet, a ring-shaped pole piece protruding in the bobbin from the rear plate, with a vibration space where the bobbin vibrates up and down being provided between the permanent magnet and the front plate, and a dust cap disposed at a center of the vibrating diaphragm.

9. The noise cancelling earset according to claim 7, wherein the balanced armature driver unit includes a frame, a pair of permanent magnets spaced apart from each other and installed in the frame, a yoke plate covering the permanent magnets, an armature having one side positioned between the permanent magnets, with an air gap being therebetween, and the other side fixed to the frame, a coil wound around a portion of the armature to induce an AC magnetic field between the armature and the permanent magnets, a connecting rod connected to the armature, and a vibrating diaphragm connected to and vibrated by the connecting rod and supported by the frame.

10. A noise cancelling earset, comprising:

a driver unit configured to be mounted in an external auditory meatus of a wearer of the earset and having a first side that faces a tympanic membrane of the wearer and a second side that faces opposite to first side, the driver unit being configured to generate and transmit a sound from the first side to the tympanic membrane; and an acoustic filter attached to the second side of the driver unit and configured to cover a back hole formed in the driver unit and having a plurality of filter layers and a plurality of plates, each of the plurality of filter layers including a sound passage, each of the plurality of plates including a through-hole that is in fluid communication with the sound passage of a neighboring filter layer, the acoustic filter configured to provide a fluid communication between the back hole and a passageway through which an extraneous noise from outside of the driver unit travels so that an air pressure in the back hole is same as an air pressure of a passageway while the extraneous noise is prevented from entering the back hole.

11. A noise cancelling earset as recited in claim 10, wherein the plurality of filter layers and the plurality of plates are alternatively stacked on each other.

12. A noise cancelling earset as recited in claim 10, wherein the sound passages formed in two adjacent filter layers of the plurality of filter layers are arranged in perpendicular to each other.

13. A noise cancelling earset as recited in claim 10, wherein the through-holes formed in two of the plurality of plates adjacent to a filter layer communicate with different ends of the sound passage of the filter layer.

14. A noise cancelling earset as recited in claim 10, wherein the sound passage is filled with a sound absorbing material.

15. A noise cancelling earset as recited in claim 14, wherein the sound absorbing material contains at least one of polyester, glass fiber, mineral wool, glass wool, and polyurethane.

16. A noise cancelling earset as recited in claim 10, wherein the driver unit includes at least one of a dynamic driver unit and a balanced armature driver unit.

17. A noise cancelling earset as recited in claim 16, wherein the dynamic driver unit includes:

a conical hollow frame;

a conical-hollow shaped vibrating diaphragm vibrating in the frame;

an edge surround elastically supporting a front end of the vibrating diaphragm at a front end of the frame;

a bobbin with a front end adhered to a center portion of the vibrating diaphragm from a rear side of the vibrating diaphragm;

a damper with an outer peripheral portion fixed to the frame and an inner peripheral portion adhered to the bobbin;

a voice coil wound around the bobbin;

a spider supporting the voice coil;

a ring-shaped permanent magnet disposed around the voice coil;

a ring-shaped front plate firmly disposed between the frame and the permanent magnet;

a ring-shaped rear plate covering a lower portion of the permanent magnet;

a ring-shaped pole piece protruding in the bobbin from the rear plate, with a vibration space where the bobbin vibrates up and down being provided between the permanent magnet and the front plate; and a dust cap disposed at a center of the vibrating diaphragm.

18. A noise cancelling earset as recited in claim 17, further comprising:

a tube having one end disposed in the back hole and extending through the driver unit to define an inner space that is isolated from a sound output space of the driver unit and having an other end into which a sound generated by the wearer and transmitted through the external auditory meatus of the wearer enters; and a microphone disposed in the inner space of the tube and configured to capture the sound that enters into the other end of the tube.

19. A noise cancelling earset as recited in claim 16, wherein the balanced armature driver unit includes:

a frame;

a pair of permanent magnets spaced apart from each other and installed in the frame;

a yoke plate covering the pair of permanent magnets;

an armature having one side positioned between the pair of permanent magnets, with an air gap being therebetween, and an other side fixed to the frame;

a coil wound around a portion of the armature to induce an AC magnetic field between the armature and the pair of permanent magnets;

a connecting rod connected to the armature; and a vibrating diaphragm connected to and vibrated by the connecting rod and supported by the frame.

* * * * *